US009079054B2

(12) United States Patent
Claessen et al.

(10) Patent No.: US 9,079,054 B2
(45) Date of Patent: Jul. 14, 2015

(54) INERT GAS FIRE EXTINGUISHER FOR REDUCING THE RISK AND FOR EXTINGUISHING FIRES IN A PROTECTED SPACE

(75) Inventors: Thomas Claessen, Kaarst (DE); Ernst-Werner Wagner, Winsen (DE)

(73) Assignee: AMRONA AG, Zug (CH)

( * ) Notice: Subject to any disclaimer, the term of this patent is extended or adjusted under 35 U.S.C. 154(b) by 1091 days.

(21) Appl. No.: 12/998,300

(22) PCT Filed: Oct. 7, 2009

(86) PCT No.: PCT/EP2009/063019

§ 371 (c)(1),
(2), (4) Date: Jul. 5, 2011

(87) PCT Pub. No.: WO2010/040771

PCT Pub. Date: Apr. 15, 2010

(65) Prior Publication Data

US 2011/0253396 A1 Oct. 20, 2011

(30) Foreign Application Priority Data

Oct. 7, 2008 (EP) ..... 08166037

(51) Int. Cl.
*A62C 35/00* (2006.01)
*A62C 2/00* (2006.01)
(Continued)

(52) U.S. Cl.
CPC ..... *A62C 99/0018* (2013.01); *A62C 35/02* (2013.01); *A62C 35/15* (2013.01); *A62C 35/68* (2013.01); *A62C 99/0027* (2013.01)

(58) Field of Classification Search
CPC ..... A62C 99/0018; A62C 99/0027; A62C 35/15; A62C 35/02
USPC ..... 169/11, 16, 44, 56
See application file for complete search history.

(56) References Cited

U.S. PATENT DOCUMENTS

| | | | | |
|---|---|---|---|---|
| 5,287,702 | A * | 2/1994 | Blackshaw et al. | 62/3.2 |
| 6,341,572 | B1 * | 1/2002 | Howell et al. | 114/230.12 |
| 6,390,203 | B1 * | 5/2002 | Borisov et al. | 169/62 |
| 6,739,399 | B2 * | 5/2004 | Wagner et al. | 169/45 |

(Continued)

FOREIGN PATENT DOCUMENTS

| | | | |
|---|---|---|---|
| DE | 19811851 | A1 | 9/1999 |
| EP | 1293230 | A1 | 3/2003 |
| EP | 1454658 | A1 | 9/2004 |
| RU | 2286190 | C1 | 10/2006 |

OTHER PUBLICATIONS

Russian Federal Service for Intellectual Property (Rospatent) on Aug. 20, 2013, in Russian Patent Application No. 2011113003/12(019266).

*Primary Examiner* — Len Tran
*Assistant Examiner* — Alexander Valvis
(74) *Attorney, Agent, or Firm* — Jean C. Edwards, Esq.; Edwards Neils PLLC

(57) ABSTRACT

The invention relates to an inert gas fire-extinguishing system for reducing the risk of and extinguishing fires in a protected room. So as to have the inerting of the protected room ensue according to different variable sequences of events, the inert gas fire-extinguishing system includes a pressure-reducing device having at least two parallel branches, wherein each parallel branch has a pressure-reducing mechanism. Each parallel branch is connectable to a high-pressure collecting line and a low-pressure extinguishing line via a controllable valve, whereby each pressure-reducing mechanism is designed to reduce a high input pressure to a low output pressure according to a known pressure-reducing characteristic curve.

7 Claims, 5 Drawing Sheets

(51) Int. Cl.

| | |
|---|---|
| ***A62C 3/00*** | (2006.01) |
| ***A62C 3/06*** | (2006.01) |
| ***A62C 37/00*** | (2006.01) |
| ***A62C 99/00*** | (2010.01) |
| ***A62C 35/15*** | (2006.01) |
| ***A62C 35/02*** | (2006.01) |
| ***A62C 35/68*** | (2006.01) |

(56) References Cited

U.S. PATENT DOCUMENTS

| | | | | |
|---|---|---|---|---|
| 7,726,410 | B2 * | 6/2010 | Wagner | 169/45 |
| 2002/0070035 | A1 | 6/2002 | Grabow et al. | |
| 2007/0034387 | A1 * | 2/2007 | Andersen et al. | 169/16 |
| 2008/0105443 | A1 * | 5/2008 | Molz et al. | 169/45 |

* cited by examiner

INERT GAS FIRE EXTINGUISHER FOR REDUCING THE RISK AND FOR EXTINGUISHING FIRES IN A PROTECTED SPACE

CROSS-REFERENCE TO RELATED APPLICATIONS

The present invention is a 35 U.S.C. 371 National Stage Entry of PCT/EP2009/063019, filed Oct. 7, 2009, which claims priority from European Patent Application No. 08166037.5, filed Oct. 7, 2008, the contents of all of which are herein incorporated by reference in their entirety.

BACKGROUND OF THE INVENTION

1. Field of the Invention

The invention relates to an inert gas fire-extinguishing system for reducing the risk of and extinguishing fires in a protected room, wherein the inert gas fire-extinguishing system includes at least one high-pressure gas tank in which an oxygen-displacing gas is stored under high pressure, wherein the high-pressure gas tank is connectable to a collecting line via a quick-opening valve; and wherein an extinguishing line is further provided which is connected on one side to the collecting line via a pressure-reducing device and on the other side to extinguishing nozzles.

2. Description of the Related Art

This type of inert gas fire-extinguishing system is known in principle in the prior art. For example, the DE 198 11 851 A1 German patent application describes an inert gas fire-extinguishing system designed to lower the oxygen content in an enclosed room (hereinafter referred to as "protected room") to a specific base inerting level and, in the event of a fire, to quickly lower the oxygen content further to a specific full inerting level, thereby enabling the effective extinguishing of a fire which has broken out in the protected room, while at the same time keeping the space required for inert gas cylinders in which oxygen-displacing gas is stored under high pressure to a minimum.

The basic principle behind inert gas fire-extinguishing technology is based on the knowledge that in closed rooms which are only entered occasionally by humans or animals, and in which the equipment housed therein reacts sensitively to the effects of water, the risk of fire can be countered by reducing the oxygen concentration in the relevant area to a value of e.g., approximately 12% by volume on average. At such a (reduced) oxygen concentration, most combustible materials can no longer ignite.

The main areas of application for inert gas extinguishing technology accordingly include IT areas, electrical switching and distribution rooms, enclosed facilities as well as storage areas containing high-value commercial goods. The extinguishing effect resulting from this method is based on the principle of oxygen displacement. As is known, normal ambient air consists of 21% oxygen by volume, 78% nitrogen by volume and 1% by volume of other gases. For extinguishing purposes, the oxygen content of the atmosphere within the enclosed room is decreased by introducing an oxygen-displacing gas, for example nitrogen. An extinguishing effect is known to begin as soon as the percentage of oxygen drops below about 15% by volume. Depending upon the combustible materials stored in the protected room, it may be necessary to further lower the percentage of oxygen to the 12% by volume value as cited as an example above. The term "base inerting level" as used herein is to be understood as referring to a reduced oxygen content compared to the oxygen content of the normal ambient air, however, whereby this reduced oxygen content poses no danger of any kind to persons or animals such that they can still enter into the protected room without any problem (i.e., without any special protective measures such as oxygen masks, for example). The base inerting level corresponds to an oxygen content within the protected room of e.g., approximately 15%, 16% or 17% by volume. On the other hand, the term "full inerting level" is to be understood as referring to an oxygen content which has been further reduced compared to the oxygen content of the base inerting level such that the flammability of most materials has already been decreased to the extent that they are no longer able to ignite. Depending upon the fire load inside the respective protected room, the full inerting level generally ranges from 11% to 12% of oxygen concentration by volume.

In a multi-stage inerting method as known for example from the DE 198 11 851 A1 printed publication, in which the oxygen content is lowered in progressive stages, an "inert gas extinguishing technology" is thus, employed to first reduce the oxygen content in the protected room to a specific lowered level (base inerting level) of e.g., 16% by volume by flooding the room at risk of or already on fire with oxygen-displacing gas such as carbon dioxide, nitrogen, noble gases or mixtures thereof, whereby in the event of a fire or when otherwise needed, the oxygen content is then further reduced to a specific full inerting level of e.g., 12% by volume or lower. If an inert gas generator, for example a nitrogen generator, is used as an inert gas source in such a two-stage inerting method for reducing the oxygen content to the first lowered level (base inerting level), this can achieve being able to keep the number of high-pressure gas tanks as needed for full inertization, in which the oxygen-displacing gas or gas mixture (hereinafter also referred to simply as "inert gas") is stored in compressed form, as low as possible.

In practical use of the above-described and known per se two-stage inerting method, however, the fact that the inerting of the protected room to set a predetermined lowered level, such as, for example, the base or full inerting level, cannot ensue according to a predefined sequence of events has proven problematic in certain cases. In particular, the currently known multi-stage inert gas fire-extinguishing systems do not allow for the fact that it might at times be desired to gradually render a protected room inert; i.e., regulating the predefined lowered to levels in progressive stages according to different sequences of events, wherein these sequences of events can be adapted to specific conditions.

In a multi-stage inerting method as known for example from the DE 198 11 851 A1 printed publication, when inert gas is introduced into the atmosphere of the protected room so as to set a specific lowered level, the method in particular does not differentiate between setting a base inerting level versus a full inerting level in the atmosphere of the room. In other words, regardless of which lowered level is to be set in the protected room with the known method, the inerting of the protected room follows one and the same inerting curve. To be understood by the term "inerting curve" as used herein is the temporal variation of the oxygen content when oxygen-displacing gas (inert gas) is introduced into the spatial atmosphere of the protected room. Due to this limitation, an inert gas fire-extinguishing system as described, for example, in the DE 198 11 851 A1 printed publication is not suited or only conditionally suited as a multi-zone fire-extinguishing system, since inertization cannot be adapted to individual protected rooms. Particularly not taken into account, is that in the case of differently dimensioned protected rooms, for example, the maximum volume of inert gas introduced per unit of time for inerting purposes should be adapted to the respective protected room. The given pressure relief as well as pressure resistance of the room's spatial shell in particular dictate the maximum allowable volume of inert gas introduced per unit of time in this context. This maximum allowable volume of inert gas introduced into the protected room per unit of time ultimately determines the sequence of events during the inerting of the protected room; i.e., the inerting curve applicable to the room.

When employing an inert gas fire-extinguishing system as a multi-zone system, thus, one in which one and the same inert gas fire-extinguishing system provides preventative fire control or extinguishing for a plurality of protected rooms, the problem thus, arises that regardless of which of the multiple protected rooms is to be flooded with oxygen-displacing gas, each protected room is rendered inert according to one and the same sequence of events. Hence, with conventional multi-zone fire-extinguishing systems, a protected room of relatively small spatial volume is fed the same volume of oxygen-displacing gas per unit of time as a protected room having a proportionally larger spatial volume. Since the volume of inert gas which can be supplied per unit of time by the inert gas fire-extinguishing system is particularly dependent on the given pressure-relieving measures for the respective protected room, this means that the inerting of a protected room may sometimes take considerably longer as would actually be possible.

Based on this problem as set forth, the invention is based on the task of further developing an inert gas fire-extinguishing system as known for example from the DE 198 11 851 A1 printed publication such that rendering a protected room inert; i.e., setting a lowered level in the spatial atmosphere of the protected room, can ensue pursuant different sequences of events.

SUMMARY OF THE INVENTION

The present invention proposes an inert gas fire-extinguishing system of the type cited at the outset, in which the pressure-reducing device comprises at least two parallel branches, each having a pressure-reducing mechanism, wherein each parallel branch can be connected to the collecting line and the extinguishing line by means of a controllable valve, and wherein each pressure-reducing mechanism is configured to reduce a high input pressure to a low output pressure according to a known pressure-reducing characteristic curve. To be understood by the terms "input pressure" and "output pressure" as used herein is the hydrostatic pressure of the medium (the oxygen-displacing gas) acting in each case on the input and output side of the respective pressure-reducing mechanism.

The advantages attainable with the inventive solutions are important and novel. Because the pressure-reducing device, via which the extinguishing line coupled to extinguishing nozzles is connected to the high-pressure collecting line (manifold), includes a plurality of parallel branches, activatable as needed by controlling the respective valves, each having a respective pressure-reducing mechanism with a known pressure-reducing characteristic curve disposed therein, the pressure reduction to be afforded by the pressure-reducing device can be easily adapted to each respective application by appropriately controlling the valves disposed in the parallel branches. It is thus, for example, conceivable to provide a pressure-reducing mechanism in a first of the at least two parallel branches, its pressure-reducing characteristic curve exhibiting a clearly higher slope compared to the pressure-reducing characteristic curve of a pressure-reducing mechanism provided in a second parallel branch. Using the pressure-reducing mechanism of the first of the at least two parallel branches to reduce pressure in this example makes it possible to increase the volume of oxygen-displacing gas fed to the extinguishing line from the inert gas fire-extinguishing system per unit of time compared to using the pressure-reducing mechanism of the second parallel branch to reduce pressure. This allows the sequence of events to be varied according to need with one and the same inert gas fire-extinguishing system when flooding a protected area and to adapt it for example to the pressure relief provided for said protected area to be flooded.

The term "pressure-reducing characteristic curve" as used herein refers to the dependency of a pressure-reducing mechanism's output pressure on the input pressure. It is thus an input/output pressure characteristic curve. The pressure-reducing characteristic curve of a pressure-reducing mechanism is particularly important in terms of how the oxygen content in the protected room changes over time during the inerting process, wherein this temporal changing of the oxygen content is also referred to herein as the "inerting curve."

Accordingly, it is clear that the inventive solution can provide for a multi-zone inert gas fire-extinguishing system with which the volume of oxygen-displacing gas which said inert gas fire-extinguishing system supplies to a protected room per unit of time can be adapted to, for example, the given pressure relief contingencies of the respective room.

Furthermore, the inventive solution also enables the respective lowered levels in a multi-stage inerting method, for instance the base or full inerting level, to be set in each case according to different inerting curves.

In a further development of the inventive solution, the inert gas fire-extinguishing system thus, also includes a control unit to automatically effect a multi-stage inerting method in which the oxygen content in the protected room is first reduced to a first lowered level (for example, a base inerting level) and, as needed, for example in the event of a fire, subsequently further reduced to one or progressively to a plurality of predefined lowered levels. In this further development, the control unit is preferably configured so as to control the valves of the pressure-reducing device such that to set the corresponding lowered level, the oxygen content in the protected room is reduced according to a predefined inerting curve.

This development thus, allows the inerting needed to set the respective lowered levels in a multi-stage inerting method to ensue automatically according to different sequences of events adapted to each respective lowered level.

In one realization of the latter cited further development, it is preferable for the control unit to be, on the one hand, designed to control the valves of the pressure-reducing device to lower the oxygen content to a first lowered level such that only one first parallel branch of the at least two parallel branches is connected to the high-pressure collecting line (manifold) and the extinguishing line, and then on the other, be designed to control the valves of the pressure-reducing device for the further reducing of the oxygen content to a second lowered level such that only one second parallel branch of the at least two parallel branches is connected to the high-pressure collecting line and extinguishing line, wherein the pressure-reducing characteristic curve of the pressure-reducing mechanism disposed in the first parallel branch differs from the pressure-reducing characteristic curve of the pressure-reducing mechanism disposed in the second parallel branch.

In this realization of the inventive solution, it is thus, conceivable to select a pressure-reducing characteristic curve for the second parallel branch, by means of which the high-pressure collecting line and the low-pressure extinguishing line are then connected together when the oxygen content in the protected room is further reduced from an existing first lowered level to a predefined second lowered level which exhibits a relatively large slope compared to the slope of the pressure-reducing characteristic curve of the pressure-reducing mechanism used in the first parallel branch. By selecting the pressure-reducing characteristic curves for the at least two pressure-reducing mechanisms in this way, the oxygen content in the protected room can be reduced from the first lowered level to the second lowered level proportionally faster than when reducing the oxygen content from e.g., its normal level to the first lowered level.

In the case of a two-stage inerting method in which the first lowered level corresponds to the base inerting level, for example, and the second lowered level corresponds to the full inerting level, for example, the inventive inert gas fire-extinguishing system of this preferred realization can ensure the fastest possible lowering of the oxygen content from the base inerting level to the full inerting level, for example in the event of a fire. However, the pressure-reducing mechanisms employed in the inerting process should preferably be configured with respect to their pressure-reducing characteristic curves so as not to exceed the maximum allowable volume of oxygen-displacing gas to be fed to a specific protected room per unit of time, particularly in order to heed the requirements for effective pressure relief when flooding the protected room and prevent any possible damage to the room's spatial shell.

Alternatively to the latter cited embodiment, it is of course also conceivable for the control unit to be designed so as to control the valves of the pressure-reducing device to reduce the oxygen content to the first lowered level, for example the base inerting level, such that only a first parallel branch of the at least two parallel branches of the pressure-reducing device is connected to the high-pressure collecting line and the low-pressure extinguishing line, whereby the control unit is further designed to control the valves of the pressure-reducing device to further reduce the oxygen content to a second lowered level, for example the full inerting level, such that the first parallel branch and a second parallel branch of the at least two parallel branches are connected to the collecting line and the extinguishing line. It is thoroughly conceivable with this embodiment—unlike with the embodiment described previously—for the pressure-reducing mechanisms disposed in the first and the second parallel branch to exhibit identical pressure-reducing characteristic curves.

When both the first as well as the second parallel branch of the pressure-reducing device is connected to the collecting line and the extinguishing line to further reduce the oxygen content to the second lowered level, this can achieve a clearly faster reducing of the oxygen content to the second lowered level compared to reducing the oxygen content to the first lowered level. There-fore, the further reducing to the second lowered level ensues pursuant a steeper inerting curve than the inerting curve applicable to reducing the oxygen content to the first lowered level. As is also the case with the embodiment described previously, when the oxygen content is being reduced to the second lowered level, it is hereby also preferred for the volume of oxygen-displacing gas fed to the protected room per unit of time not to exceed a maximum allowable volumetric flow as stipulated for the protected room, especially in terms of its given pressure relief.

The solution according to the invention is not limited to a pressure-reducing device only comprising two parallel branches. Particularly for applications in which a protected room is to be rendered inert (lowered level) in more than two steps, the pressure-reducing device should have a correspondingly higher number of parallel branches. It is thus, conceivable for the inert gas fire-extinguishing system to first reduce the oxygen content in the protected room to e.g., a base inerting level, whereby in the event of a fire in the protected room (or when otherwise needed), the oxygen content can be further reduced from the base inerting level to a lower lowered level and continuously maintained at that lowered level for a predefined amount of time, wherein the oxygen content is then subsequently further reduced from said lowered level to a full inerting level if a fire has not yet been extinguished after a predefined amount of time has passed. In order to be able to individually adapt the sequence of events and in particular the inerting curve in this type of (three-stage) inerting of the protected room when setting the respective lowered level (base inerting level, lowered level, full inerting level) for each reduction of oxygen content to be realized, it is preferred for the pressure-reducing device of the inventive inert gas fire-extinguishing system to comprise at least three parallel branches, each having a respective pressure-reducing mechanism, wherein each parallel branch is connectable to the collecting line and the extinguishing line by means of a controllable valve, and wherein each pressure-reducing mechanism is designed to reduce a high input pressure to a low output pressure pursuant a known pressure-reducing characteristic curve. With this embodiment of the inert gas fire-extinguishing system, it is further realized for the control unit to be designed to control the valves of the pressure-reducing device to reduce the oxygen content from the second lowered level to a third lowered level (for example the full inerting level) such that only one third parallel branch of the at least three parallel branches is connected to the collecting line and the extinguishing line.

The solution according to the invention therefore, enables different pressure-reducing measures to be used for each inerting stage (each lowered level) of a multi-stage inerting method in order to individually set the volume of oxygen-displacing gas fed to the protected room per unit of time when the respective lowered level is being set such that the oxygen content can be reduced to the individual lowered levels according to different inerting curves. This is then, of particular advantage when different volumes of oxygen-displacing gas are needed to set the individual lowered levels; i.e., when there are different intervals between the respective lowered levels.

In inert gas fire-extinguishing technology, pressure diaphragms are currently normally used as pressure-reducing mechanisms in order to lower a relatively high input pressure (of e.g., 300 bar) to an output pressure of e.g., 60 bar on average. A pressure-reducing mechanism configured as a pressure diaphragm exhibits a pressure-reducing characteristic curve in which the output pressure is proportionally dependent on the input pressure. Upon the quick-opening valves of the inert gas fire-extinguishing system being opened, the oxygen-displacing gas stored under high pressure in the at least one high-pressure gas tank flows into the high-pressure collecting line (manifold), whereby the pressure-reducing mechanism thereafter reduces the high gas pressure within the collecting line to a working pressure of e.g., 60 bar. Thus, the extinguishing line can be configured as a low-pressure line whereas a high-pressure manifold is to be selected for the collecting line.

It is to be kept in mind that during the inerting of the protected room, the initial high pressure in the high-pressure collecting line drops relatively rapidly with the emptying of at least one high-pressure gas tank connected to the collecting line via an open quick-opening valve. If a pressure diaphragm is used as the pressure-reducing mechanism, i.e., a baffle with a bore hole, the inerting curve exhibits a high pressure peak at the beginning of the inerting process which drops relatively quickly in proportion to the pressure in the collecting line. However, this type of pressure peak at the beginning of the inerting process is problematic in terms of the pressure relief to be accorded the protected room since the pressure relief is adapted to the maximum volume of oxygen-displacing gas fed into the atmosphere of the protected room per unit of time.

It is therefore, preferred with the inventive inert gas fire-extinguishing system for at least some of the pressure-reducing mechanisms to exhibit a pressure-reducing characteristic curve in which the output pressure, independently of the established input pressure, does not exceed a predefined pressure value above a specific pressure range (working range). A pressure-reducing mechanism exhibiting a linear pressure-reducing characteristic curve, e.g., a pressure regulator, ensures that despite different pressures at the input side (input pressure), a specific output pressure will not be exceeded at the output side. It is hereby conceivable for a pressure-reducing mechanism configured as a pressure regulator to comprise a spring-loaded diaphragm, for example, whereby pressure on the input side acts on said diaphragm. The diaphragm is to be further mechanically coupled to a valve such that the valve closes continually further the higher the pressure is at the output side. Upon an (adjustable) maximum allowable output pressure being reached, the valve should fully cut off the gas flow.

The solution according to the invention is not limited to an inert gas fire-extinguishing system only including one high-pressure gas tank. In one embodiment, the inert gas fire-extinguishing system includes at least two high-pressure gas tanks connectable to the collecting line via a quick-opening valve, wherein each high-pressure gas tank is dedicated to one parallel branch having a pressure-reducing mechanism. This allocation ensues such that opening the quick-opening valve of one of the at least two high-pressure gas tanks automatically controls the valves of the pressure-reducing device such that only the associated parallel branch of the one high-pressure gas tank is connected to the extinguishing line and the collecting line.

Thus, it is to be noted that the inventive inert gas fire-extinguishing system is designed to realize an inerting method in which the oxygen content in the protected room is initially reduced to and maintained at a specific first lowered level, and wherein in the event of a fire in the protected room (or when otherwise needed), the oxygen content in the protected room is then further reduced from the first lowered level to a set second lowered level. The inventive inerting system can thus achieve a reducing of the oxygen content in the protected room to the first lowered level pursuant a first inerting curve which is predefined by a pressure-reducing characteristic curve of a first pressure-reducing mechanism and the further reducing of the oxygen content in the protected room to the second lowered level pursuant a second inerting curve which is predefined by a pressure-reducing characteristic curve of a second pressure-reducing mechanism.

In realizing the above-cited inerting method, it is preferable to use a detector to measure at least one fire characteristic in the protected room, preferably continuously, so as to determine whether there is a fire within the protected room or whether a fire which has broken out in the protected room has already been extinguished by successful inertization. However, measuring of the fire characteristic does not need to occur continuously, it is instead also conceivable for such a measurement to be made at predetermined times or contingent upon certain predefined events. Measuring the fire characteristic is preferably performed by a detector for detecting a fire characteristic which, in the event of fire, emits a corresponding signal to the control unit to render the protected room inert, preferably automatically, by activating the corresponding quick-opening valves and valves of the pressure-reducing device.

One realization of the inventive solution provides for detecting a fire characteristic using an aspirative system which extracts representative samples of air from the protected room and feeds them to the fire characteristic detector.

The term "fire characteristic" is to be understood as a physical variable subject to measurable changes in the ambient air of an incipient fire, e.g. the ambient temperature, the solid, liquid or gaseous content in the ambient air (accumulation of smoke particles, particulate matter or gases) or the ambient radiation. It is, for example, conceivable for an aspirative fire detection system to extract representative samples of air from the protected room being monitored and feed them to a fire characteristic detector which then emits a corresponding signal to the control unit in the event of a fire.

To be understood as an aspirative fire detection device is a fire detection device which extracts a representative portion of the atmospheric air of the protected room being monitored from a plurality of locations within said protected room, for example via a pipe or duct system, and then feeds these air samples to a measuring chamber housing the fire characteristic detector. Particularly conceivable would be for the fire characteristic detector to be designed so as to emit a signal which also enables a quantitative conclusion to be made as regards the presence of fire characteristics in the portion of atmospheric air extracted. It would therefore, be possible to detect the progression of the fire over time and/or the chronological development of the fire in order to thus determine the effectiveness of setting and maintaining the different lowered levels in the protected room. It would, in particular, be possible to thereby draw a conclusion as to the necessary volume of inert gas needed to be supplied to the protected room to extinguish the fire.

The invention is not only limited to the inert gas fire-extinguishing systems described above; it also relates to an inerting method which can be realized with the inventive inert gas fire-extinguishing system for reducing the risk of and extinguishing fires in a protected room. In a first step of this inerting method, the oxygen content in the protected room is reduced to a specific first lowered level. This ensues by means of a preferably regulated introduction of an oxygen-displacing gas (inert gas) which is stored in at least one high-pressure gas tank under high pressure or provided by a nitrogen generator. Thereafter, the oxygen content in the protected room is maintained at or below the first lowered level—by the regulated added feed of inert gas or by continuously supplying additional inert gas as needed. In the event of a fire in the protected room, or when otherwise needed, the oxygen content in the protected room is thereafter further reduced from the first lowered level to a specific second lowered level. In accordance with the invention, the inerting method provides for reducing the oxygen content in the protected room to the first lowered level to ensue in accordance with a first inerting curve which is predefined by a pressure-reducing characteristic curve of a first pressure-reducing mechanism and for the further reducing of the oxygen content in the protected room to the second lowered level to ensue in accordance with a second inerting curve which is predefined by a pressure-reducing characteristic curve of a second pressure-reducing mechanism.

A further reducing of the oxygen content in the protected room from the second lowered level to a specific third lowered level is of course also conceivable as needed.

The inerting method according to the invention can in particular be realized by an inert gas fire-extinguishing system which—as described above—includes a pressure-reducing device having at least two parallel branches, and in which the oxygen-displacing gas is stored under high pressure of for example up to 300 bar in high-pressure gas tanks (such as, e.g., steel cylinders). Before introducing the oxygen-displacing gas into the protected room, it is reduced from its initially high storage pressure to a working pressure of preferably a maximum of 60 bar by a pressure-reducing mechanism arranged in a first parallel branch of the pressure-reducing device. To reduce the pressure, the pressure-reducing mechanism arranged in the first parallel branch comprises a diaphragm having a predetermined aperture opening calculated, for example, with the appropriate software.

It is known that upon the high-pressure gas tank being emptied, the storage pressure in the extinguishing agent tanks, and thus, also the input pressure acting on the pressure-reducing mechanism disposed in the first parallel branch, will drop. The working pressure behind the aperture opening of the pressure-reducing mechanism will likewise fall; i.e., the output pressure of the pressure-reducing mechanism disposed in the first parallel branch.

With the falling pressure in the high-pressure gas tank and/or behind the aperture opening of the pressure-reducing mechanism arranged in the first parallel branch, the mass/volumetric flow of oxygen-displacing gas introduced into the protected area will also decrease. In order to have a defined volume of oxygen-displacing gas be introduced into the protected area within a pre-defined time period, a correspondingly high mass/volumetric flow at the start of flooding thus needs to be ensured, whereby this high mass/volumetric flow present at the start of flooding is contingent on the falling storage pressure upon the emptying of the high-pressure gas tank. Problematic, however, is that the high mass/volumetric flow present at the start of flooding subjects the protected area to corresponding pressures of excess pressure, turbulence, etc.

It is possible with the inventive solution to provide for a steady mass/volumetric flow over the given period of time in a particularly easily realized yet effective manner in order to prevent pressure and volumetric flow peaks at the beginning of the flooding and thus be able to reduce to a minimum the protective measures required in the protected area (e.g., pressure-relief openings).

It is, for example, possible with the inventive solution to have the supply of oxygen-displacing gas be activated in one step, wherein this supply is combined with activating the pressure-reducing device arranged after the extinguishing agent reserve in stages—and thus the pressure-reducing mechanisms for example in the form of apertures. This, thus, has the effect of the oxygen-displacing gas flowing through a small aperture cross-section at high supply pressure at the beginning of flooding and through a gradually enlarging aperture cross-section as the supply pressure drops. The volumetric flow peak as occurs with conventional extinguishing systems is thus capped at the beginning of flooding, whereby the resultant safety measures can also be reduced.

The activating of the individual parallel branches of the pressure-reducing device, and thus, the activating of the individual pressure-reducing mechanisms for example in the form of apertures can ensue cumulatively, wherein a further parallel branch can then be activated and the aperture cross-section of the pressure-reducing mechanisms used to reduce pressure then added thereto at specific (predefined) time points. Alternatively hereto, it is of course, also conceivable to have the parallel branches of the pressure-reducing device having pressure-reducing mechanisms with differently sized apertures (or in more general terms with different pressure-reducing characteristic curves) be activated and then deactivated again at the various time points.

Generally speaking, the invention thus also relates to an inerting method for reducing the risk of and extinguishing fires in a protected room in which an oxygen-displacing gas stored under high pressure is initially reduced to a working pressure and thereafter introduced into the protected room in order to reduce the oxygen content in the protected room to a specific lowered level, wherein a first pressure-reducing mechanism, through which the oxygen-displacing gas flows at the beginning of reducing the oxygen content, is used to reduce the pressure of the oxygen-displacing gas stored under high pressure, and wherein at least one second pressure-reducing mechanism, through which the oxygen-displacing gas does not flow until after a specific amount of time has passed since pressure reduction has begun, is used to further reduce the pressure of the oxygen-displacing gas stored to under high pressure.

BRIEF DESCRIPTION OF THE DRAWINGS

The following will make reference to the accompanying figures in describing exemplary embodiments of the inventive inert gas fire-extinguishing system in greater detail.

Shown are.

DESCRIPTION OF THE INVENTION

Figure 1:
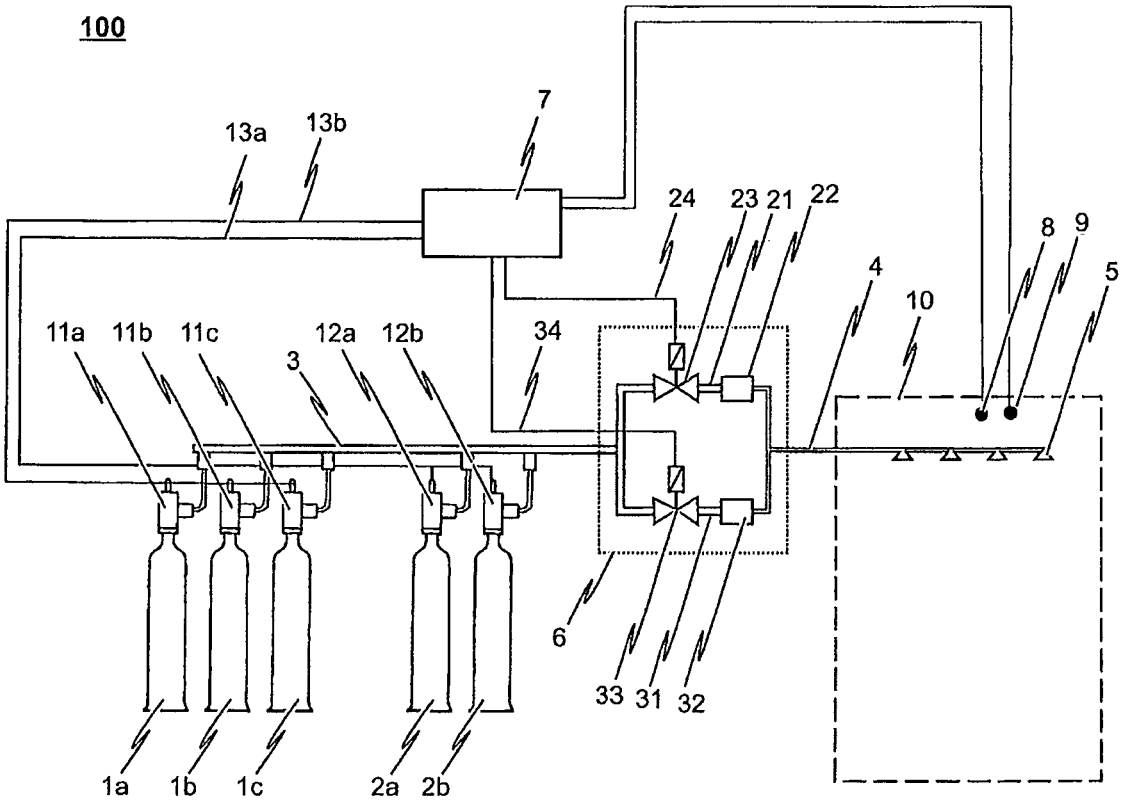
FIG. 1 is a schematic view of first exemplary embodiment of the inventive inert gas fire-extinguishing system.

FIG. 1 shows a schematic view of a first preferred embodiment of the inventive inert gas fire-extinguishing system 100. The inert gas fire-extinguishing system 100 includes a total of five high-pressure gas tanks 1*a*, 1*b*, 1*c*, 2*a*, 2*b*, each realized for example as standard commercial 200-bar or 300-bar high-pressure gas cylinders. Also conceivable here would be using one or more high-pressure gas reservoirs in place of the high-pressure gas cylinders, for example, in the form of high-pressure gas storage pipes. An oxygen-displacing gas or gas mixture, consisting for example of nitrogen, carbon dioxide and/or noble gas, is stored under high pressure in the high-pressure gas tanks 1*a*, 1*b*, 1*c*, 2*a*, 2*b*.

In the embodiment of the inert gas fire-extinguishing system 100 as depicted, the high-pressure gas tanks 1*a*, 1*b*, 1*c*, 2*a*, 2*b* are divided into two groups consisting of high-pressure gas tanks 1*a*, 1*b*, 1*c* and high-pressure gas tanks 2*a*, 2*b*. Dividing the high-pressure gas tanks 1*a*, 1*b*, 1*c* and 2*a*, 2*b* into batteries of high-pressure gas tanks has the advantage that not all of the high-pressure gas tanks 1*a*, 1*b*, 1*c*, 2*a*, 2*b* need to be simultaneously used in a multi-stage inert gas fire-extinguishing system to set a specific lowered level in the atmosphere of a protected room 10, but rather only high-pressure gas tanks 1*a*, 1*b*, 1*c* or 2*a*, 2*b* can be used.

Each high-pressure gas tank 1*a*, 1*b*, 1*c*, 2*a*, 2*b* can be connected to a high-pressure collecting line 3 by means of a quick-opening valve 11*a*, 11*b*, 11*c*, 12*a*, 12*b*. The respective quick-opening valve 11*a*, 11*b*, 11*c*, 12*a*, 12*b* can be controlled as needed by a control unit 7 via the corresponding control lines 13*a*, 13*b* in order to connect the associated high-pressure gas tank 1*a*, 1*b*, 1*c*, 2*a*, 2*b* to the high-pressure collecting line 3.

The high-pressure collecting line 3 is connected to a pressure-reducing device 6. The function of pressure-reducing device 6 consists of reducing the oxygen-displacing gas flowing under high pressure into the high-pressure collecting line 3 after at least one quick-opening valve 11*a*, 11*b*, 11*c*, 12*a*, 12*b* has been opened to a predetermined working pressure of for example 60 bar. Thus, there is relatively high gas pressure acting on the input side of the pressure-reducing device 6 which is reduced to the lower working pressure by means of pressure-reducing mechanisms 22, 32. The output side of pressure-reducing device 6 is connected to a low-pressure extinguishing line 4 through which the oxygen-displacing gas reduced to a specific working pressure in the pressure-reducing device 6 as dictated by the pressure-reducing mechanisms 22, 32 is fed into the protected room 10. As shown schematically in FIG. 1, the low-pressure extinguishing line 4 discharges into the protected room 10 through a plurality of extinguishing nozzles 5.

According to the invention, the pressure-reducing device 6 includes at least two, and in the embodiment according to FIG. 1 exactly two, parallel branches 21, 31. One of the above-cited pressure-reducing mechanisms 22, 32 is arranged in each parallel branch 21, 31. The individual pressure-reducing mechanisms 22, 32 of the respective parallel branches 21, 31 are connectable on one side to the high-pressure collecting line 3 by means of the corresponding valves 23, 33 controllable by the control unit 7 and on the other side to the low-pressure extinguishing line 4. Although the respective valves 23, 33 are arranged between the high-pressure collecting line 3 and the respective pressure-reducing mechanism 22, 32 in the representation depicted in FIG. 1, it is of course, also conceivable for the valves 23, 33 to be provided between the respective pressure-reducing mechanisms 22, 32 and the low-pressure extinguishing line 4.

Corresponding control lines 24, 34 are provided to actuate the respective valves 23, 33 of pressure-reducing device 6, through which control commands can be transmitted from the control unit 7 to the valves 23, 33. The control unit 7 is moreover connected to the above-cited quick-opening valves 11*a*, 11*b*, 11*c*, 12*a*, 12*b* of high-pressure gas tank 1*a*, 1*b*, 1*c*, 2*a*, 2*b* via control lines 13*a* and 13*b* so as to be able to selectively connect the given high-pressure gas tank 1*a*, 1*b*, 1*c*, 2*a*, 2*b* associated with the quick-opening valves 11*a*, 11*b*, 11*c*, 12*a*, 12*b* to the high-pressure collecting line 3 as needed.

As an example, in the embodiment of the inert gas fire-extinguishing system 100 depicted in FIG. 1, the pressure-reducing mechanisms 22, 32 disposed in the two parallel branches 21, 31 each exhibit different pressure-reducing characteristic curves. It is, for example, conceivable for the pressure-reducing mechanism 22 arranged in the first parallel branch 21 to be configured as a pressure regulator having a constant pressure-reducing characteristic curve over a fixed range of pressure. Should valve 23 thus, be opened by control unit 7 to flood the protected room 10, and valve 33 arranged in the second parallel branch 31 closed, the oxygen-displacing gas under high pressure in the high-pressure collecting line 3 flows—provided at least one quick-opening valve 11*a*, 11*b*, 11*c*, 12*a*, 12*b* is opened by control unit 7—through the first parallel branch 21 of the pressure-reducing device 6 to the low-pressure extinguishing line 4 and from there into the protected room 10 via the extinguishing nozzles 5.

Since the pressure-reducing mechanism 22 disposed in the first parallel branch 21 in the exemplary embodiment according to FIG. 1 exhibits a constant pressure-reducing characteristic curve, a constant volume of oxygen-displacing gas is fed into the protected room 10 per unit of time—provided valve 23 is open and valve 33 is closed. The inerting curve for the feed of inert gas through the first parallel branch 21 of pressure-reducing device 6 is thus linear. The slope of the (linear) inerting curve is on the one hand dependent on the spatial volume of the enclosed protected room 10 and, on the other, on the (constant) working pressure at the output of pressure-reducing device 6 as reduced by pressure-reducing mechanism 22. Depending on the pressure value to which the pressure-reducing mechanism 22 configured for example as a pressure regulator reduces the high pressure within the high-pressure collecting line 3, the linear inerting curve is more or less steep.

The pressure-reducing mechanism 32 arranged in the second parallel branch 31 can likewise be configured as a pressure regulator, for example, which thus delivers a constant output pressure over a specific range of operation regardless of input pressure. It is hereby preferably provided for the pressure-reducing characteristic curve of the pressure-reducing mechanism 32 arranged in the second parallel branch 31 to be configured differently from the pressure-reducing characteristic curve of the pressure-reducing mechanism 22 arranged in the first parallel branch 21. It is, thus, for example, conceivable for the pressure-reducing mechanism 32 arranged in the second parallel branch to provide a constant output pressure which is greater than the reduced pressure at the output of pressure-reducing mechanism 22 disposed in the first parallel branch 21. This, thus, enables the oxygen-displacing gas to be fed into the protected room 10 at different volumetric flows by the appropriate controlling of valves 23, 33. In terms of the necessary pressure relief, the maximum volumetric flow supplied to the protected room 10 should thereby be adapted to the maximum volume of inert gas permitted to be fed into the protected room 10 per unit of time.

As FIG. 1 shows, the inventive inert gas fire-extinguishing system 100 is furthermore equipped with a fire detection system comprising at least one fire characteristic sensor 9. This fire characteristic sensor 9 is connected to control unit 7 by means of a control line in the depicted embodiment. The fire detection system checks on a continuous basis, or at predetermined times or upon predetermined events, whether a fire has broken out in the air of the enclosed room 10. Upon detecting a fire characteristic, the fire characteristic sensor 9 emits a corresponding signal to control unit 7. Control unit 7 then preferably automatically initiates the inerting of the enclosed room 10.

The inerting method which can be realized with the help of control unit 7 will be described below in conjunction with FIGS. 3*a*, 3*b* and 4*a*, 4*b*.

It can further be noted from FIG. 1 that the inert gas fire-extinguishing system 100 according to the exemplary depicted embodiment is further equipped with a sensor 8 for detecting the oxygen concentration in the spatial atmosphere of the protected room 10. The values measured by sensor 8 on a continuous basis, or at predetermined times or upon predetermined events, are fed to control unit 7 via a corresponding data line. Aided by the control unit 7, doing so, thus, makes it possible to keep the oxygen concentration in the protected room 10 at a predefined lowered level by the additional feed of oxygen-displacing gas within a specific control range as needed.

Figure 2:
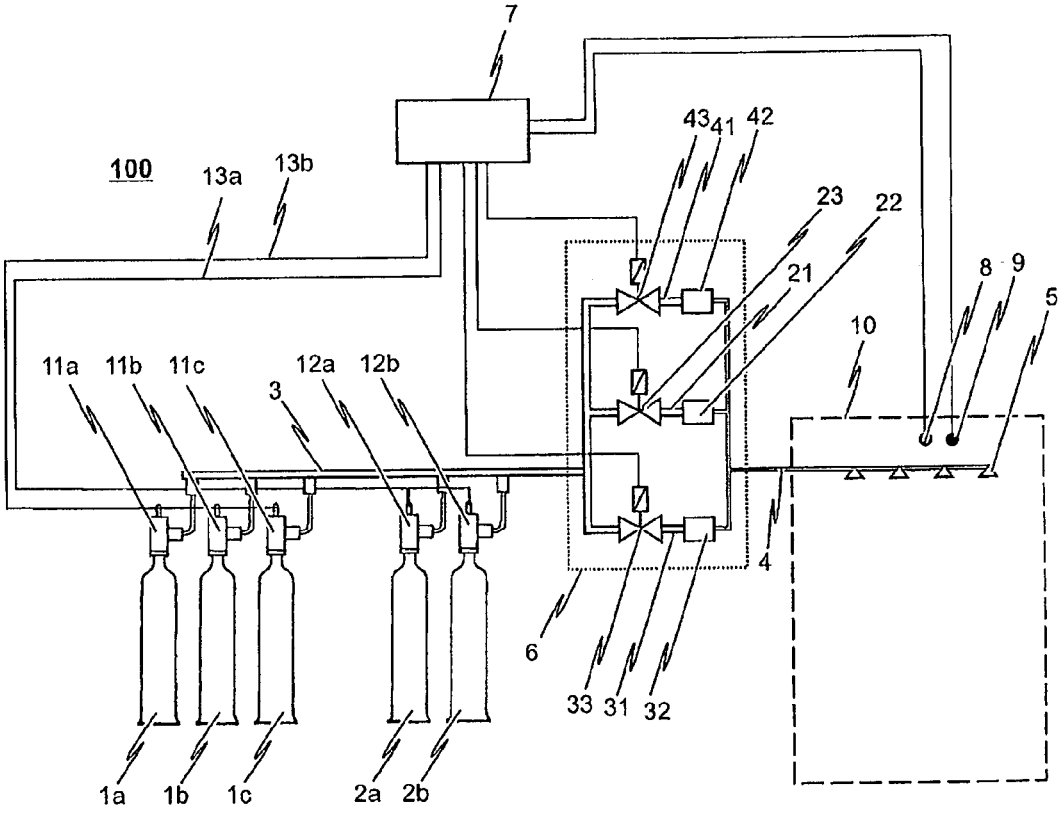
FIG. 2 is a schematic view of a further exemplary embodiment of the inventive inert gas fire-extinguishing system.

FIG. 2 shows a further embodiment of the inventive inert gas fire-extinguishing system 100. The design of the inert gas fire-extinguishing system 100 shown in FIG. 2, essentially corresponds to the system described with reference to FIG. 1; although with the exception that the embodiment of the pressure-reducing device 6 shown in FIG. 2 has a total of three parallel branches 21, 31 and 41, each including a pressure-reducing mechanism 22, 32, 42. Each parallel branch 21, 31, 41 of pressure-reducing device 6 is thereby connectable to the high-pressure collecting line 3 and the low-pressure extinguishing line 4 via a corresponding valve 23, 33, 43 controllable by control unit 7.

The individual pressure-reducing mechanisms 22, 32, 42 in the embodiment depicted in FIG. 2 preferably exhibit different pressure-reducing characteristic curves. By selectively having either one of the total of three parallel branches 21, 31, 41, or two of the total of three parallel branches 21, 31, 41, or all three of the parallel branches 21, 31, 41 be simultaneously connected to the high-pressure collecting line 3 on the one side and the low-pressure extinguishing line 4 on the other by the appropriate actuating of valves 23, 33, 43, the inerting of the protected room 10 can correspondingly follow a total of six different inerting curves.

The pressure-reducing mechanisms 21, 31, 41 depicted in FIGS. 1 and 2 can be configured as pressure regulators exhibiting a constant, linear pressure-reducing characteristic curve at least over a specific range of input pressure so as to provide—independent of the input pressure (pressure in high-pressure collecting line 3)—a constant output pressure value. Should the pressure reduction hereby ensue with just one pressure regulator, the inerting curve assumes a linear gradient having a specific slope, whereby the slope of the inerting curve can be influenced by varying the volume of oxygen-displacing gas flowing through pressure-reducing device 6 per unit of time.

On the other hand, however, it is of course also conceivable for at least some of the pressure-reducing mechanisms 22, 23, 42 used in the pressure-reducing device 6 to be configured as pressure diaphragms, wherein pressure reduction ensues by changing the cross-section by means of a baffle having a bore hole of a specific diameter. The configured size of the bore hole is adapted to the intended application of the inert gas fire-extinguishing system. A pressure-reducing mechanism in which the pressure reduction ensues with a pressure diaphragm exhibits a curving pressure-reducing characteristic curve which is dependent on the gradient of the input pressure (pressure in high-pressure collecting line 3) and thus, allows pressure spikes, particularly immediately after the opening of one of the quick-opening valves 11*a*, 11, 11*c*, 12*a*, 12*b*.

When the protected room 10 is rendered inert by means of a pressure-reducing mechanism which has a pressure diaphragm for pressure reducing purposes, the inerting curve assumes an arching gradient.

Although the embodiments of the inventive inert gas fire-extinguishing system 100 shown schematically in FIGS. 1 and 2 are depicted as single-zone extinguishing systems, their use as multi-zone fire extinguishing systems are of course also conceivable. To this end, it is only required to provide the corresponding multi-zone valves, for example downstream of the pressure-reducing device 6 from which the low-pressure extinguishing lines lead to the respective protected rooms. The control unit 7 correspondingly controls the multi-zone valves so as to connect specific low-pressure extinguishing lines with the output of pressure-reducing device 6.

The following will make reference to FIGS. 3*a*, 3*b* and 4*a*, 4*b* in describing the inerting method which can be realized with the inert gas fire-extinguishing system 100 according to the invention.

Figure 3A:
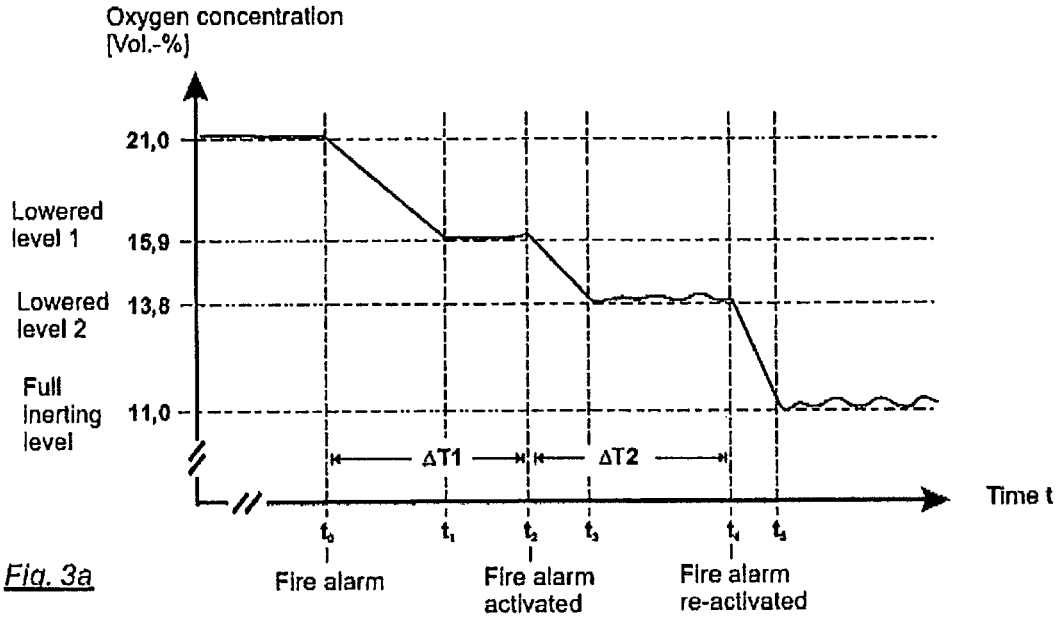
FIG. 3*a* is the chronological progression of the oxygen concentration in a protected room when employing the inerting method using an embodiment of the inventive inert gas fire-extinguishing system.
Figure 3B:
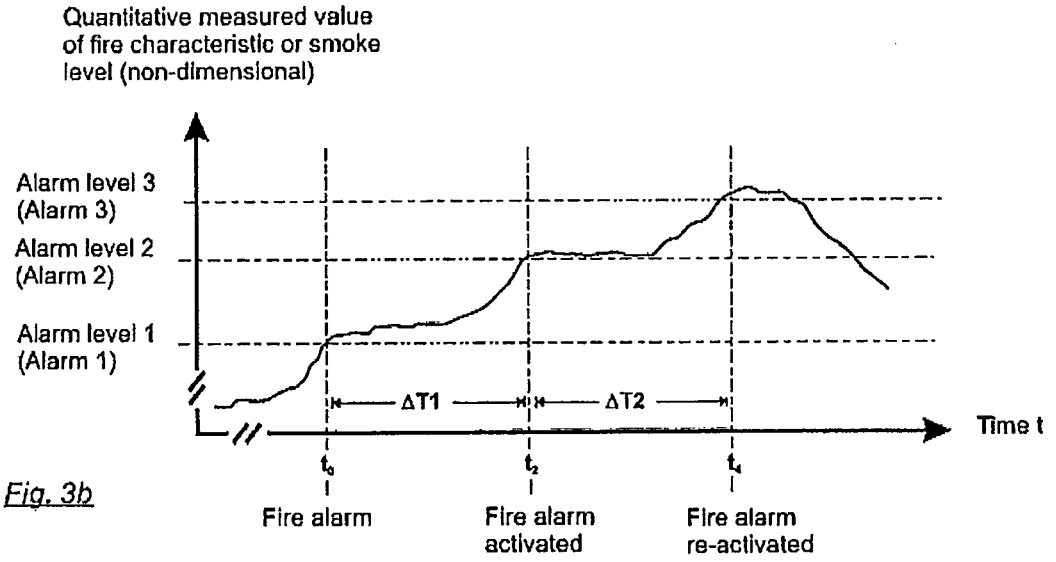
FIG. 3*b* is the chronological progression of a quantitative measured value of a fire characteristic, the smoke level respectively, in a protected room in which the oxygen concentration is lowered in accordance with the curve progression shown in FIG. 3*a* when employing a preferred embodiment of the inventive inert gas fire-extinguishing system.

FIGS. 3*a* and 3*b* respectively show the oxygen concentration and the quantitative measured value of a fire characteristic or smoke level detected by means of the fire characteristic sensor 9 in the protected room, whereby an inert gas fire-extinguishing system 100 according to the present invention can be used to realize a multi-stage inerting method. It can be noted from the representations provided in FIGS. 3*a* and 3*b* that there is an oxygen concentration of approximately 21% by volume in protected room 10 up until timepoint $t_0$, the oxygen concentration thus corresponding to normal ambient air.

The rendering of protected room 10 inert begins at timepoint $t_0$ by continually feeding an oxygen-displacing gas into the spatial atmosphere of the enclosed room 10 until timepoint $t_1$. Obvious from the FIG. 3*a* depiction is that the inerting curve progresses linearly and relatively evenly within the $t_0$-$t_1$ time interval. This curving form to the inerting curve is made possible by for example having one first of the at least two parallel branches 21, 31, 41 of pressure-reducing device 6 be connected to the high-pressure collecting line 3 and the low-pressure extinguishing line 4, wherein a pressure-reducing mechanism 22 configured as a pressure regulator is provided in said first parallel branch 21.

At timepoint $t_1$, the oxygen content in the enclosed room 10 is reduced to a first lowered level of e.g. 15.9% by volume. The oxygen content is maintained at this first lowered level until timepoint $t_2$. Doing so preferably ensues by oxygen sensor 8 continuously measuring the oxygen concentration in the protected room 10 and introducing oxygen-displacing gas or fresh air into the protected room in a regulated manner. To be understood here by the phrase "maintaining the oxygen concentration at a specific lowered level" is keeping the oxygen concentration within a specific control range; i.e. within a range defined by an upper and a lower threshold. The maximum amplitude of the oxygen concentration in this control range is predefinable and amounts for example to 0.1 to 0.4% by volume.

In the scenario shown in FIG. 3*a*, the fire characteristic detector 9 depicted in FIGS. 1 and 2 sends a fire alarm to control unit 7 at timepoint $t_0$ which then initiates the inerting; i.e., controls the reducing of the oxygen content to the first lowered level. Specifically, as can be noted from FIG. 3*b*, the smoke level, respectively the quantitative value of the fire characteristic measured continuously or at predetermined times by fire characteristic detector 9 has exceeded a first threshold (alarm threshold 1) at said timepoint $t_0$. In reaction to this fire alarm, the oxygen content in the protected room is reduced from its original 21% by volume to the first lowered level. The first lowered level (lowered level 1) corresponds to an oxygen concentration of about 15.9% by volume in the curve progression depicted in FIG. 3*a*. As can be noted from the temporal progression of FIG. 3*a*, the reducing of the oxygen content to the first lowered level ensues over a relatively long interval of time ($t_1$-$t_0$) because during the inerting; i.e., during the reducing of the oxygen content to the first lowered level, active firefighting is already occurring.

By continuously monitoring the development of the fire in the protected room 10 while the oxygen content is being reduced to the first lowered level allows the determination to be made as to whether the fire has already been completely extinguished during the lowering phase.

In the scenario depicted in FIGS. 3*a* and 3*b*, the fire was not able to be completely extinguished by timepoint $t_2$, as can be realized from the fire characteristic development according to FIG. 3*b*. Instead, the quantitative value of the fire characteristic in the atmosphere of the protected room 10 has steadily risen in this depicted scenario, and that despite the oxygen content being reduced to the first lowered level. This indicates that despite the reduced oxygen content, the fire in protected room 10 has not been completely extinguished.

Should, as is the case in the scenario depicted in FIGS. 3*a* and 3*b*, the quantitative measured value of the fire characteristic exceed a second predefined alarm threshold after a first predefined amount of time ΔT1; i.e., at timepoint $t_2$, it will then be assumed that the fire is not yet extinguished so that the fire alarm emitted at timepoint $t_0$ will be re-activated. The re-activating of the fire alarm at timepoint $t_2$ causes the oxygen concentration in the protected room 10 to be further reduced from the first lowered level (of about e.g., 15.9% oxygen by volume) to a second lowered level relatively quickly. This ensues by rapidly introducing a specific amount of oxygen-displacing gas (inert gas) so that the oxygen concentration reaches the second lowered level of e.g., 13.8% oxygen by volume relatively quickly after the fire alarm has been actuated at time-point $t_2$. Comparing the inerting curve within the $t_0$-$t_1$ and $t_2$-$t_3$ intervals shows that the inerting curve while reducing the oxygen content to the second lowered level is likewise linear, although exhibits a clearly greater slope compared to the inerting curve within the $t_0$-$t_1$ interval.

The slope of the inerting curve is increased in the depicted embodiment for example by the actuating of, additionally to the first parallel branch 21, a second parallel branch 31 in the pressure-reducing device 6 in which is arranged a pressure-reducing mechanism 32 in the form of a pressure regulator. In contrast to the pressure-reducing mechanism 22 arranged in the first parallel branch 21 of pressure-reducing device 6, however, the pressure-reducing mechanism 32 of the second parallel branch 31 is preferably configured to yield a higher output pressure so that the inerting curve increases more sharply when reducing to the second lowered level.

It is also evident from the associated progression of the curve in FIG. 3*b* that even the renewed introducing of inert gas to set the second lowered level did not lead to complete containment of the fire which broke out in the protected room. While the quantitative measured value of the fire characteristic does initially indicate stagnation in the ΔT2 time frame, meaning that the fire could at least be suppressed from spreading in the protected room, after a certain amount of time, the smoke level, respectively the quantitative measured value of the fire characteristic, begins to rise again and even exceeds alarm threshold 3, upon which a main alarm is triggered. The exceeding of alarm threshold 3 ensues in the scenario depicted in FIG. 3*b* at timepoint $t_4$.

The re-activating of the fire alarm at timepoint $t_4$ has the effect of the oxygen content in the protected room now being further reduced from the second lowered level to the full inerting level, which this time occurs by the fastest possible introduction of a corresponding volume of oxygen-displacing gas into the spatial atmosphere of the protected room. In detail, at least two parallel branches 21, 31 are opened simultaneously in the pressure-reducing device 6 for this purpose so as to allow the largest possible inert gas flow rate through said pressure-reducing device 6. Since the pressure-reducing mechanisms 22, 32 employed for pressure reduction purposes are each configured as pressure regulators, the inerting curve again assumes a linear course when the oxygen content is being reduced from the second lowered level to the third lowered level (full inerting level), albeit with even further re-ascending inerting curve.

The full inerting level is preferably established such that it corresponds to an oxygen concentration which is lower than the ignition point of the materials present in the protected room (fire load). Upon the full inerting level being set in the protected room, the fire is, thus, completely extinguished due to oxygen deprivation, whereby a re-igniting of the materials in the protected room is at the same time effectively prevented.

To be noted from the progression of the curve in FIG. 3*b* is that after the full inerting level has been set (at timepoint $t_5$), the quantitative measured value of the fire characteristic decreases on a continuous basis, meaning that the fire is or will be extinguished. The full inerting level should be maintained for at least the length of time it takes for the temperature in the protected room to drop below the critical ignition point of the material. It would, however, also be conceivable to maintain the full inerting level until relief units arrive and take the inert gas fire-extinguishing system out of its automatic fire-extinguishing mode, for example by means of manual resetting.

In realizing the inerting method, as exemplified by means of the FIGS. 3*a* and 3*b* representations, the full inerting level is thereby set over two intermediate stages, namely the first and the second lowered level. In so doing, a different pressure-reducing procedure is used for each intermediate stage, which is ultimately reflected in the temporal progression of the inerting curve.

Figure 4A:
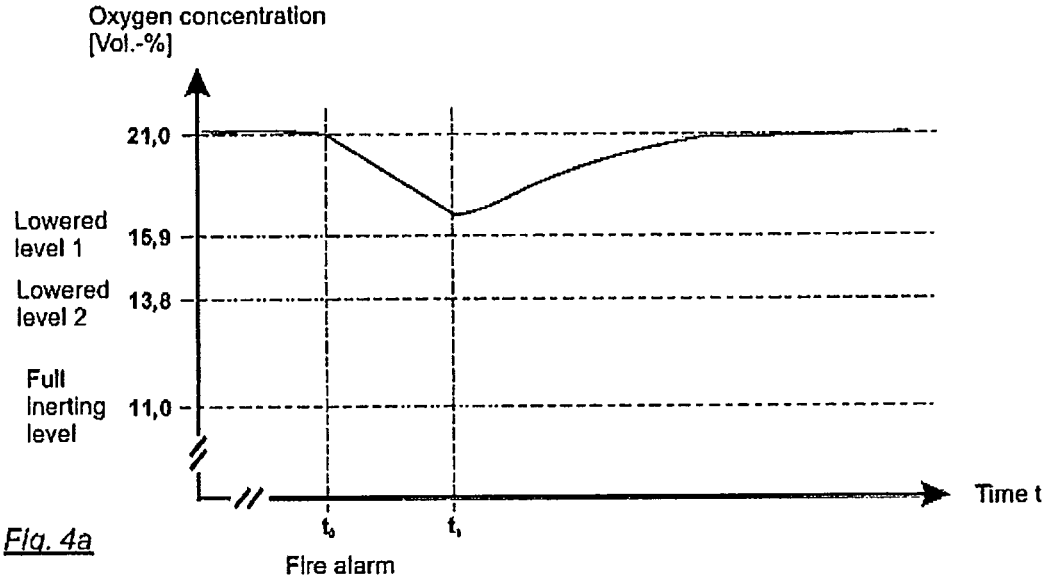
FIG. 4*a* is the chronological progression of the oxygen concentration in a protected room when employing an embodiment of the inventive inert gas fire extinguishing system to realize a multi-stage inerting method, wherein the fire has already been extinguished during the reducing of the oxygen content to a first lowered level.
Figure 4B:
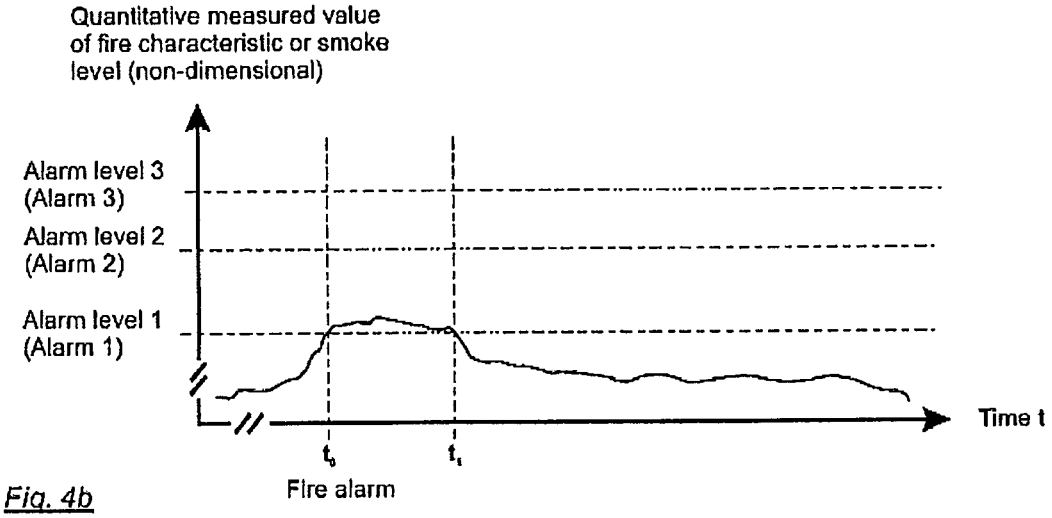
FIG. 4*b* is the chronological progression of the quantitative measured value of a fire characteristic, the smoke level respectively, in a protected room in which the oxygen concentration is lowered in accordance with the curve progression shown in FIG. 4*a* when employing a preferred embodiment of the inventive inert gas fire-extinguishing system.

FIGS. 4*a* and 4*b* depict a different scenario in which the oxygen content is reduced from its original 21% by volume to the first lowered level (e.g., 15.9% by volume) according to a linear inerting curve which exhibits a deliberate lesser gradient to the extent that the oxygen content in the protected room does not drop to the first lowered level until after a relatively long period of time. By slowly introducing the oxygen-displacing gas into the protected room, no special pressure relief measures need to be incorporated. Moreover, the development or extinguishing of the fire can be very closely monitored while the oxygen content is being lowered.

With the scenario depicted in FIG. 4, it can be noted from the progression of the curve in FIG. 4*b* that after the fire alarm is triggered at timepoint $t_0$, the quantitative measured value of the fire characteristic first stagnates and then decreases continuously, this being an indication of the fire in the protected room having been extinguished. At timepoint $t_1$, the quantitative measured value of the fire characteristic falls below the first alarm threshold, in consequence of which the introduction of oxygen-displacing gas for setting the first lowered level can be stopped. Hence, the inventive solution enables a need-based adjusting of the volume of inert gas used for extinguishing purposes.

Figure 5:
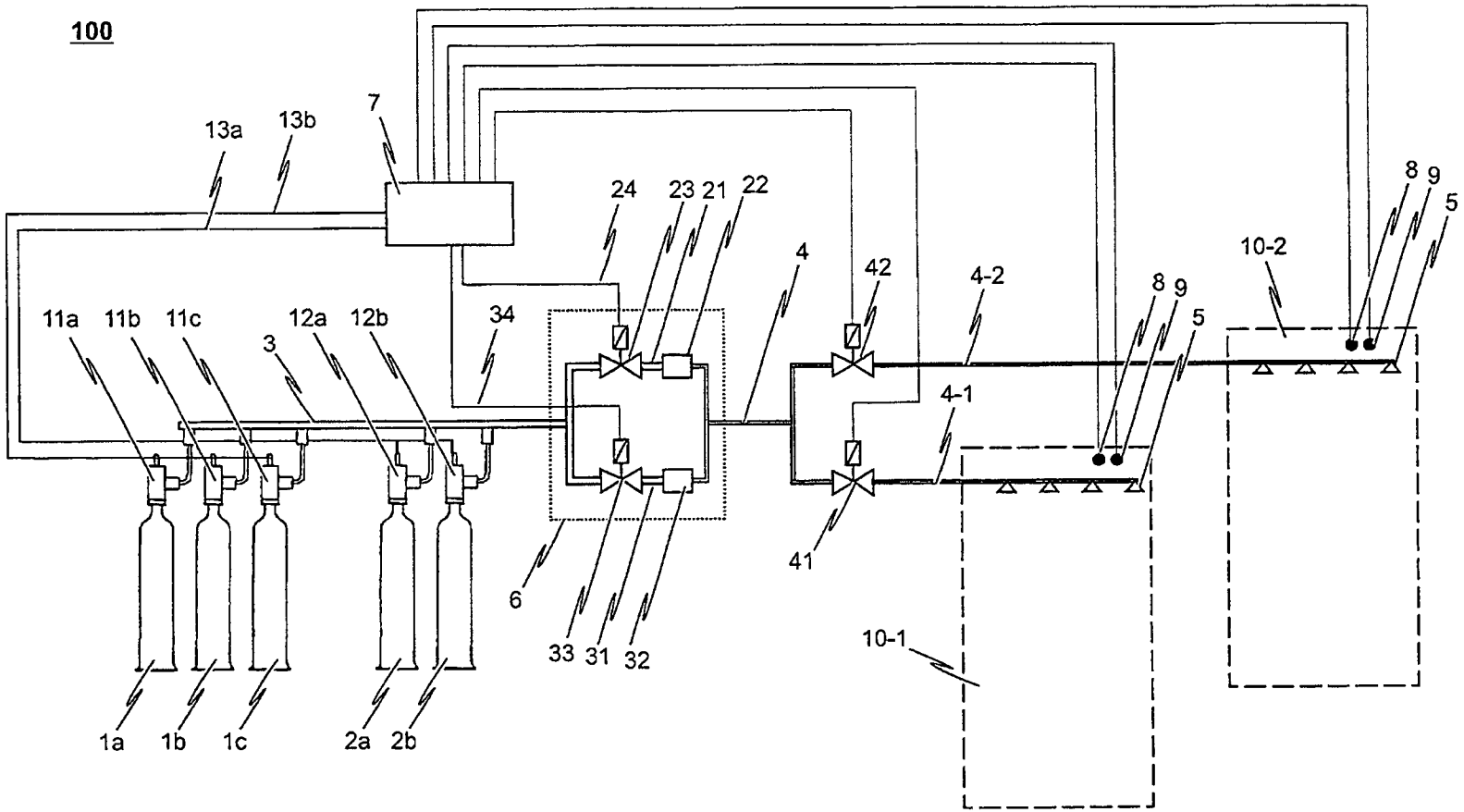
FIG. 5 is a schematic view of a further exemplary embodiment of the inventive inert gas fire-extinguishing system configured in the form of a multi-zone system.

FIG. 5 shows a schematic view of a further exemplary embodiment of the inventive inert gas fire-extinguishing system 100, wherein said inert gas fire-extinguishing system 100 is this time configured as a multi-zone system allowing one and the same inert gas fire-extinguishing system 100 to provide preventive fire control or fire extinguishing for a total of two protected rooms 10-1 and 10-2.

As noted at the outset, problematic with conventional multi-zone fire-extinguishing systems is that regardless of which protected room is to be flooded with an oxygen-displacing gas, the inerting of the protected room follows one and the same sequence of events. Thus, conventional multi-zone fire-extinguishing systems feed the same amount of oxygen-displacing gas into a protected room having a relatively small spatial volume as a protected room having a proportionally larger spatial volume. Since the volume of inert gas able to be provided by the inert gas fire-extinguishing system per unit of time is in particular dependent upon the given pressure-relief measures for the respective protected rooms, this means that the inerting of a protected room can sometimes take considerably longer as would actually be possible.

The inventive solution, depicted in an exemplary embodiment in FIG. 5, is able to achieve preventative fire control or extinguishing for a plurality of protected rooms 10-1, 10-2 in a particularly simple to realize yet effective manner with one and the same inert gas fire-extinguishing system 100, wherein the inerting to be initiated in one of the plurality of protected rooms 10-1, 10-2 in the event of a fire or when otherwise needed can be adapted to the respective protected room. Particularly factored in is for example adapting the maximum volume of inert gas to be introduced per unit of time for inerting purposes into the respective protected room in the case of differently dimensioned protected rooms. As already indicated at the outset, particularly the given pressure relief and pressure resistance contingencies to the room's spatial shell hereby dictate the maximum volume of inert gas allowed to be introduced into the protected room per unit of time. This maximum volume of inert gas allowed to be introduced into the protected room per unit of time ultimately determines the sequence of events to occur when rendering the protected room inert; i.e. the inerting curve applicable to the room.

The multi-zone fire-extinguishing system 100 depicted schematically in FIG. 5 substantially corresponds to the single-zone fire-extinguishing system described above with reference to the representation provided in FIG. 1. In detail, the multi-zone fire-extinguishing system 100 according to FIG. 5 exhibits a plurality of high-pressure gas tanks 1*a*, 1*b*, 1*c*, 2*a*, 2*b*, which can again each be realized for example as standard commercial 200-bar or 300-bar high-pressure gas cylinders and in which an oxygen-displacing gas or gas mixture can be stored under high pressure. Each high-pressure gas tank 1*a*, 1*b*, 1*c*, 2*a*, 2*b* can be connected to a high-pressure manifold 3 by means of a quick-opening valve 11*a*, 11*b*, 11*c*, 12*a*, 12*b* actuatable by a control unit 7. The high-pressure collecting line 3 is connected to a pressure-reducing device 6 comprising at least two, and in the embodiment according to FIG. 5 exactly two, parallel branches 21, 31. One of the above-cited pressure-reducing mechanisms 22, 32 is arranged in each parallel branch 21, 31. The individual pressure-reducing mechanisms 22, 32 of the respective parallel branches 21, 31 are connectable on one side to the high-pressure collecting line 3 by means of the corresponding valves 23, 33 actuatable by the control unit 7 and on the other side to a low-pressure extinguishing line 4 connected at the output side of said pressure-reducing device 6.

In contrast to the single-zone fire-extinguishing system depicted schematically in FIG. 1, the low-pressure extinguishing line 4 connected to the output side of pressure-reducing device 6 in the multi-zone fire-extinguishing system 100 depicted in FIG. 5 divides into two parallel branches 4-1 and 4-2, whereby each parallel branch 4-1, 4-2 discharges into one of the two protected rooms 10-1, 10-2 via a respective plurality of extinguishing nozzles 5. Each parallel branch 4-1, 4-2 of the low-pressure extinguishing line 4 can be connected to the low-pressure extinguishing line 4 and thus to the output side of pressure-reducing device 6 by means of a zone valve 41, 42 controllable by a control unit 7.

In the embodiment of the multi-zone fire-extinguishing system 100 depicted in FIG. 5, each of the pressure-reducing mechanisms 22, 32 provided in the two parallel branches 21, 31 of pressure-reducing device 6 exhibit a pressure-reducing characteristic curve adapted to one of the two protected rooms 10-1, 10-2. For example, it is conceivable for the pressure-reducing mechanism 22 arranged in the first parallel branch 21 to exhibit a pressure-reducing characteristic curve adapted to the maximum allowable pressure for the first protected room. Should the control unit 7 accordingly open valve 23 to flood the first protected room 10-1 and the valve 33 disposed in the second parallel branch 31 be closed, the oxygen-displacing gas under high pressure within high-pressure collecting line 3 flows—provided the control unit 7 opens at least one quick-opening valve 11*a*, 11*b*, 11*c*, 12*a*, 12*b*—through the first parallel branch 21 of pressure-reducing device 6 to the low-pressure extinguishing line 4. Provided that the control unit 7 opens the zone valve 41 for the first protected room 10-1 and the zone valve 42 for the second protected room 10-2 remains closed, the pressure-reduced gas in the first parallel branch 21 of pressure-reducing device 6 flows through parallel branch 4-1 and extinguishing nozzles 5 into the first protected room 10-1.

Since the pressure-reducing mechanism 22 arranged in the first parallel branch 21 exhibits a pressure-reducing characteristic curve adapted to the maximum allowable pressure for the first protected room 10-1, the inerting of said first protected room 10-1 ensues pursuant a sequence of events specifically adapted to said first protected room 10-1.

Since the pressure-reducing mechanism 32 arranged in the second parallel branch 31 of the pressure-reducing device 6 can exhibit a pressure-reducing characteristic curve adapted to the maximum allowable pressure for the second protected room 10-2, the inerting of said second protected room 10-2 can also ensue as needed pursuant a sequence of events specifically adapted to said second protected room 10-2.

The invention is not limited to the exemplary embodiments depicted in the drawings but rather yields from a consideration of the invention as described herein as a whole.

The invention claimed is:

1. An inert gas fire-extinguishing system which reduces a risk of and extinguishes fires in a protected room, the inert gas fire-extinguishing system comprising:

at least one high-pressure gas tank in which an oxygen-displacing gas is stored under high pressure, wherein the high-pressure gas tank is connected to a collecting line via a quick-release valve, and an extinguishing line connected on one side to the collecting line via a pressure-reducing device and on the other side to extinguishing nozzles, wherein the pressure-reducing device includes at least two parallel branches, each having a pressure regulator, wherein each parallel branch is connected to the collecting line and the extinguishing line via a controllable valve, wherein each pressure regulator is configured to reduce a high input pressure to a low output pressure according to a known pressure-reducing characteristic curve, the inert gas fire-extinguishing system further comprising:

a control device to automatically effect, based on measurement by a sensor of at least one fire characteristic in the protect room, a multi-stage inerting process in which the oxygen content in the protected room is first reduced to a first lowered level and then further reduced to another preset lowered level or successively to multiple preset lowered levels, wherein the control device is configured to control the valves of the pressure-reducing device to set the lowered level such that the oxygen content in the protected room reduces in accordance with a preset inerting curve, wherein the control device is configured to control the valves of the pressure-reducing device to reduce the oxygen content to the first lowered level such that only one first parallel branch of the at least two parallel branches is connected to the collecting line and the extinguishing line, and wherein the control device is further configured to control the valves of the pressure-reducing device to further reduce the oxygen content to a second lowered level such that only one second parallel branch of the at least two parallel branches is connected to the collecting line and the extinguishing line, and wherein the pressure-reducing characteristic curve of the pressure regulator arranged in the first parallel branch differs from the pressure-reducing characteristic curve of the pressure regulator arranged in the second parallel branch, such that the reduction of the oxygen content in the protected room from the first lowered level to the other preset lowered level is performed as needed according to a desired inerting curve, which is a function of temporal changing of the oxygen content such that the sequence of events may be varied according to need by controlling the valves, of the pressure-reducing device, respectively disposed in each of the parallel branches.

2. The inert gas fire-extinguishing system according to claim 1, wherein the control device is configured to control the valves of the pressure-reducing device to reduce the oxygen content to the first lowered level such that only one first parallel branch of the at least two parallel branches is connected to the collecting line and the extinguishing line, and wherein the control device is further configured to control the valves of the pressure-reducing device to further reduce the oxygen content to the second lowered level such that the first parallel branch and the second parallel branch of the at least two parallel branches are connected to the collecting line and the extinguishing line.

3. The inert gas fire-extinguishing system according to claim 1, wherein the pressure-reducing device includes at least three parallel branches each having a pressure regulator, wherein each parallel branch is connected to the collecting line and the extinguishing line via a controllable valve, and wherein each pressure regulator is configured to reduce a high input pressure to a low output pressure according to a preset pressure-reducing characteristic curve, and wherein the control device is configured to control the valves of the pressure-reducing device to reduce the oxygen content from the second lowered level to a third lowered level such that only one third parallel branch of the at least three parallel branches is connected to the collecting line and the extinguishing line.

4. The inert gas fire-extinguishing system according to claim 1, wherein at least some of the pressure regulator exhibit a pressure-reducing characteristic curve with which, irrespective of a set input pressure, the output pressure does not exceed a predefined pressure value.

5. The inert gas fire-extinguishing system according to claim 1, wherein at least some of the pressure regulator exhibit a pressure-reducing characteristic curve with which the output pressure is proportionally dependent on the input pressure.

6. The inert gas fire-extinguishing system according to claim 1, wherein at least some of the pressure regulator exhibit a pressure-reducing characteristic curve with which, irrespective of a set input pressure, the output pressure assumes a predefinable constant pressure value over at least a specific range of pressure.

7. The inert gas fire-extinguishing system according to claim 1, further comprising:

at least two high-pressure gas tanks which are connected to a collecting line via a quick-release valve, wherein a parallel branch having a pressure regulator is allocated to each high-pressure gas tank such that when the quick-release valve of one high-pressure gas tank of the at least two high-pressure gas tanks-opens, the valves of the pressure-reducing device are automatically controlled such that only the parallel branch associated with the one high-pressure gas tank is connected to the extinguishing line and the collecting line.

* * * * *